US008628824B2

(12) United States Patent
Li

(10) Patent No.: US 8,628,824 B2
(45) Date of Patent: Jan. 14, 2014

(54) MANUFACTURE METHOD FOR FORMING ANTIQUE COLOR ON METAL SURFACE

(76) Inventor: Pi-Chu Li, Taipei (TW)

( * ) Notice: Subject to any disclaimer, the term of this patent is extended or adjusted under 35 U.S.C. 154(b) by 0 days.

(21) Appl. No.: 13/373,469

(22) Filed: Nov. 15, 2011

(65) Prior Publication Data

US 2013/0122203 A1 May 16, 2013

(51) Int. Cl.
*B05D 3/12* (2006.01)

(52) U.S. Cl.
USPC ..... 427/292; 427/289; 427/290

(58) Field of Classification Search
USPC ..... 427/292, 290, 289
See application file for complete search history.

(56) References Cited

FOREIGN PATENT DOCUMENTS

EP 1518609 A1 * 3/2005

OTHER PUBLICATIONS eHow, How to paint metal to look old, Apr. 7, 2011, http://www.ehow.com/print/how_5552995_paint-metal-look-old.html accessed on Feb. 27, 2013.*

Wikipedia, Metal Furniture, http://en.wikipedia.org/wiki/Metal_furniture accessed on Feb. 27, 2013.*

* cited by examiner

*Primary Examiner* — Kelly M Gambetta
(74) *Attorney, Agent, or Firm* — Charles E. Baxley

(57) ABSTRACT

A manufacture method for forming an antique color on a metal surface includes a metal surface treatment step, a first spraying step, a rubbing step, a second spraying step and a surface drying step. A paint used in the second spraying step is a color and light-permeable powder paint. Thus, a metal color, obtained after the rubbing step, and a color of the powder paint appear the antique color, such as an antique copper color or an antique silver color. Furthermore, the surface drying step homogenizes the powder paint and enhances protection and uniformity of the metal surface.

3 Claims, 3 Drawing Sheets

MANUFACTURE METHOD FOR FORMING ANTIQUE COLOR ON METAL SURFACE

BACKGROUND OF THE INVENTION

1. Field of the Invention

The invention relates to the technological field of metal surface machining, and more particularly to a manufacture method for coloring a non-copper or non-silver metal material so that the surface of the metal material finally appears an antique copper or antique silver color.

2. Related Art

The frequently seen copper or silver antique object encounters the long-time oxidation, and thus has the surface colors appearing the antique and simple feeling. The consumers have the high acceptance and the favorable impression on this color. However, the number of the antique objects is not high and the antique object has the high price, so that the ordinary person cannot possess the antique object.

At present, most of the objects with the antique copper color or the antique silver color are manufactured by way of surface machining to make the non-copper or non-silver metal surface appear the color and feeling similar to or approaching those of the antique copper or antique silver. Thus, the objects with the antique copper color or the antique silver color can be produced under the mass-production and low-cost conditions.

Referring to FIG. 1, a conventional surface machining method includes the following steps.

In a metal surface polishing treatment (12), a surface of a metal body is rubbed and polished.

In a plating treatment (14), a layer of copper material (copper plating layer) is plated on the polished surface of the metal body.

In a rubbing treatment (16), a dark brown film formed by oxidation on the copper plating layer is partially damaged using a machine tool.

In a painting treatment (18), a transparent lacquer layer is coated on the surface of the metal body to cover the copper plating layer.

In the conventional method, the plating process is required. So, the wastewater and the heavy metal are produced to contaminate the environment and cause the problem of environment protection. Furthermore, the coating uniformity of the transparent lacquer layer is poor, and the transparent lacquer layer tends to be detached after a period of time.

SUMMARY OF THE INVENTION

It is therefore an object of the invention to provide a manufacture method for forming an antique color on a metal surface, wherein the method has the effects of environment protection, the low cost and the good surface uniformity.

According to the objects and effects of the invention, a manufacture method provided includes a metal surface treatment step, a first spraying step, a rubbing step, a second spraying step and a surface drying step. The paint used in the second spraying step is a color and light-permeable powder paint, so that the metal color, obtained after the rubbing step, is mixed with the color of the powder paint to appear an antique copper color. Furthermore, the surface drying step can homogenize the powder paint and enhance the smoothness and uniformity of the metal surface.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1:
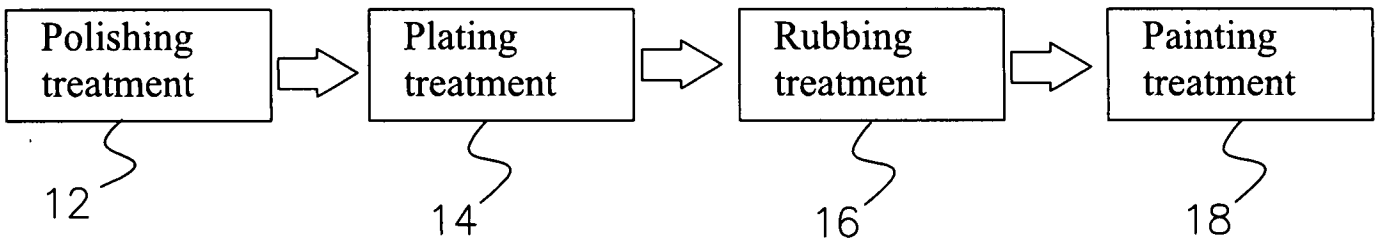
FIG. 1 (Prior Art)
FIG. 1 is a flow chart showing a conventional manufacture method for forming an antique color on a surface of a metal body.
Figure 2:
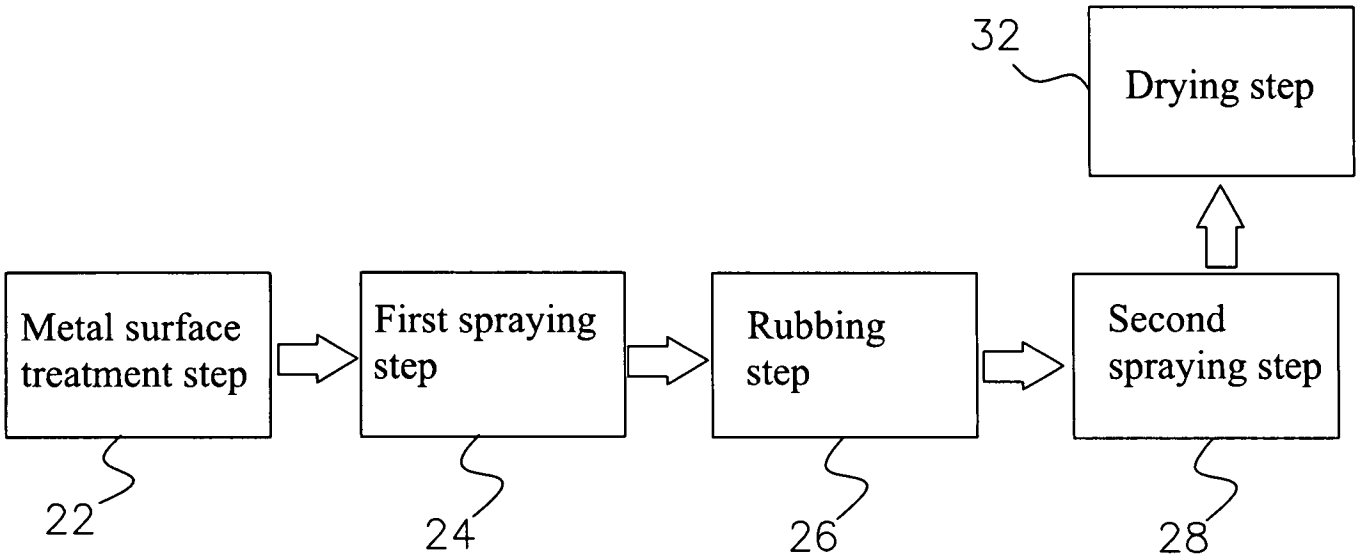
FIG. 2 is a flow chart showing a manufacture method for forming an antique color on a surface of a metal body according to the invention.

Referring to FIG. 2, the manufacture method of the invention includes a metal surface treatment step 22, a first spraying step 24, a rubbing step 26, a second spraying step 28 and a surface drying step 32.

Figure 3:
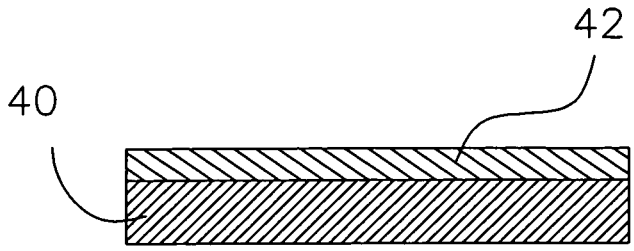
FIG. 3 is a schematic illustration showing an implementing state of a metal surface treatment step and a first spraying step according to the invention.

As shown in FIGS. 2 and 3, in the metal surface treatment step 22, a metal body 40 made of a non-copper material is taken, and a surface of the metal body 40 is rubbed and polished. The non-copper metal body 40 itself has the silver white color, or has the silver white color after machining and treatment.

Also, in the first spraying step 24, a primer layer 42 is sprayed or coated on the polished surface of the metal body 40. More particularly, the color of the primer layer 42 may be chosen to be dark. Then, the primer layer 42 may be dried.

Figure 4:
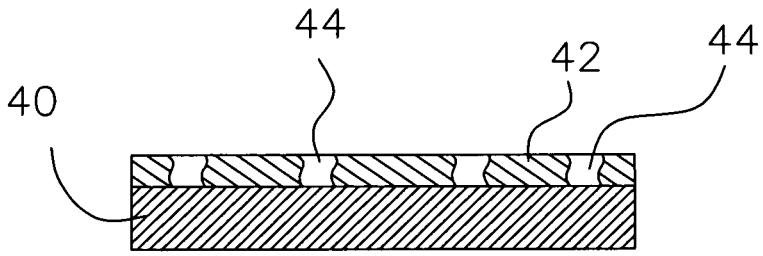
FIG. 4 is a schematic illustration showing an implementing state of a rubbing step according to the invention.

As shown in FIGS. 2 and 4, in the rubbing step 26, a machine tool is adopted to rub the primer layer 42 and thus to damage a portion of the primer layer 42 to produce line-like or block-like hollow structures 44 with different thicknesses, and to make the surface color of the metal body 40 be exposed from the damaged regions or positions.

Figure 5:
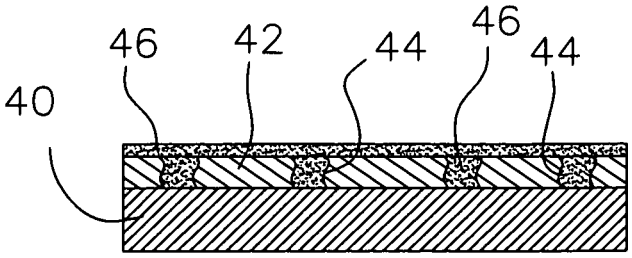
FIG. 5 is a schematic illustration showing an implementing state of a second spraying step according to the invention.

As shown in FIGS. 2 and 5, in the second spraying step 28, a color and light-permeable powder paint 46 is sprayed and coated on the primer layer 42. Thus, the color of the surface of the metal body 40 exposed by way of grinding and rubbing is mixed with the color of the powder paint 46 in the rubbing step 26, so that a portion of the surface of the metal body, exposed through the rubbing step or the entire surface of the metal body can appear the color of the antique copper or antique silver material.

In the surface drying step 32 of FIG. 2, the metal body coated with the powder paint is dried so that the powder paint is homogenized and a dried state of the powder paint is formed.

The above-mentioned manufacture method can make the surface of the non-copper metal body have the antique copper or antique silver color. Most important of all, the overall manufacture method is performed without the plating process. So, the manufacture method of the invention with two spraying steps and two drying steps can further satisfy the requirement of environment protection as compared with the conventional plating method.

Next, the invention contains no plating process, but utilizes the spray painting and color mixing methods to form the antique copper or antique silver color and feeling. Thus, the cost is low and the requirement of mass production can be satisfied.

Furthermore, after the powder paint is sprayed and heated, it can appear the good uniformity, have the good adhesive property without easy detachment, and satisfy the requirement in the actual use.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A manufacture method of forming an antique color on a metal surface, the method comprising:

a metal surface treatment step of taking a metal body made of a non-copper material and polishing a surface of the metal body;

a first spraying step of spraying a primer layer on the polished surface of the metal body;

a rubbing step of rubbing the primer layer to damage a portion of the primer layer and to expose the surface of the metal body;

a second spraying step of coating a color and light-permeable powder paint on the primer layer, wherein a color of the color and light-permeable powder paint, a color of the surface of the metal body and a color of the primer layer are mixed so that the surface of the metal body appears the antique color; and a surface drying step of drying the metal body, coated with the color and light-permeable powder paint, so that the color and light-permeable powder paint is homogenized and a dried state of the color and light-permeable powder paint is formed, wherein in the rubbing step of rubbing the primer layer to damage the portion of the primer layer and to expose the surface of the metal body, line-like or block-like hollow structures with different thicknesses are formed on the primer layer so that the color of the surface of the metal body can be exposed from damaged regions or positions.

2. The method according to claim 1, wherein the color of the surface of the metal body is silver white.

3. The method according to claim 1, wherein the primer layer has a dark color.

* * * * *